US007705808B2

(12) United States Patent
Jeon et al.

(10) Patent No.: US 7,705,808 B2
(45) Date of Patent: Apr. 27, 2010

(54) DRIVING APPARATUS AND DRIVING METHOD FOR AN ELECTRON EMISSION DISPLAY

(75) Inventors: Dong Hyup Jeon, Cheonan-si (KR); Chul Ho Lee, Cheonan-si (KR)

(73) Assignee: Samsung SDI Co., Ltd., Gyeonggi-do (KR)

( * ) Notice: Subject to any disclaimer, the term of this patent is extended or adjusted under 35 U.S.C. 154(b) by 567 days.

(21) Appl. No.: 11/362,836

(22) Filed: Feb. 28, 2006

(65) Prior Publication Data

US 2006/0221018 A1 Oct. 5, 2006

(30) Foreign Application Priority Data

Mar. 29, 2005 (KR) ..... 10-2005-0026171

(51) Int. Cl.
*G09G 3/22* (2006.01)

(52) U.S. Cl. ..... 345/74.1; 345/54; 345/96

(58) Field of Classification Search ..... 345/74.1, 345/54, 79, 96, 74, 100
See application file for complete search history.

(56) References Cited

U.S. PATENT DOCUMENTS

| | | | | |
|---|---|---|---|---|
| 6,151,006 | A * | 11/2000 | Yanagi et al. | 345/94 |
| 6,304,242 | B1 * | 10/2001 | Onda | 345/99 |
| 2001/0040548 | A1 * | 11/2001 | Ikeda | 345/92 |
| 2004/0070581 | A1 * | 4/2004 | Hiraki et al. | 345/209 |

FOREIGN PATENT DOCUMENTS

| | | | |
|---|---|---|---|
| KR | 10-2000-034675 | A | 6/2000 |
| KR | 10-0296872 | B1 | 5/2001 |
| WO | WO 02/33689 | A1 | 4/2002 |

* cited by examiner

*Primary Examiner*—Amare Mengistu
*Assistant Examiner*—Premal Patel
(74) *Attorney, Agent, or Firm*—Lee & Morse P.C.

(57) ABSTRACT

A driving apparatus, and a driving method for an electron emission display, includes a controller for comparing external video data input signals, switching a polarity control signal in a predetermined period on the basis of the comparison and controlling a video data output signal in accordance with the polarity control signal, and a data driver for modulating the video data signal output from the controller. The switching of the polarity control signal may be shifted temporally when the comparison indicates the video data input signals have the same gray level.

23 Claims, 5 Drawing Sheets

DRIVING APPARATUS AND DRIVING METHOD FOR AN ELECTRON EMISSION DISPLAY

BACKGROUND OF THE INVENTION

1. Field of the Invention

The present invention relates to a driving apparatus and a driving method for an electron emission display. More particularly, the present invention relates to a driving apparatus and a driving method for an electron emission display in which a pulse width frequency of an output signal is switched fewer times, reducing total power consumption.

2. Discussion of Related Art

In a general flat panel display (FPD), a container is formed by sealing two substrates with a lateral wall therebetween and appropriate materials are arranged within the container to realize display of a desired image. The demand for FPDs has been increasing. Accordingly, various FPDs, e.g., a liquid crystal display (LCD), a plasma display panel (PDP), an electron emission display, etc., have been developed and employed.

The electron emission display uses an electron beam to make a fluorescent material emit light, similar to the operation of a cathode ray tube (CRT). The electron emission display has the good qualities of both the CRT and the FPD, while consuming less power and displaying an image without distortion. Further, the electron emission display is anticipated as a next generation display because it fulfills numerous requirements, e.g., fast response time, high brightness, fine pitch, thinness, etc.

In general, an electron emission device uses a hot cathode or a cold cathode as an electron source. Cold cathode devices include a field emitter array (FEA) type, a surface conduction emitter (SCE) type, a metal-insulator-metal (MIM) type, a metal-insulator-semiconductor (MIS) type, a ballistic electron surface emitting (BSE) type, etc.

The electron emission display typically has a triode structure of a cathode electrode, an anode electrode and a gate electrode. In more detail, the cathode electrode, generally used as a scan electrode, is formed on a substrate. An insulating layer formed with a hole and the gate electrode, generally used as a data electrode, are sequentially formed on the cathode electrode. Then, an emitter is formed as the electron source within the hole and in contact with the cathode electrode.

In the electron emission display with this configuration, the emitter emits electrons by focusing a high electric field thereon, which can be explained by the quantum tunneling effect. The electrons emitted from the emitter are accelerated by a voltage applied between the cathode electrode and the anode electrode, and collide with red, green and blue (RGB) fluorescent materials provided on the anode electrode, so that the fluorescent materials emit light, thereby displaying a predetermined image.

The brightness of an image displayed as the emitted electrons collide with the fluorescent materials is varied according to values of an input digital video signal. In more detail, the digital video signal has a value of 8 bits corresponding to each of red (R), green (G) and blue (B) data. That is, the digital video signal has a value ranging from 0 ($00000000_{(2)}$) to 255 ($11111111_{(2)}$). Thus, 256 gray levels can be represented depending on 256 values of the digital video signal and the brightness is represented by an associated digital value.

In general, a pulse width modulation (PWM) method or a pulse amplitude modulation (PAM) method is used to control the brightness represented by the values of the digital video signal.

The PWM method modulates the pulse width of a driving waveform applied to the data electrode in accordance with the digital video signals input from a data electrode driver. When the digital video signal having a value of 255 is input within the allowable maximum on-time, the pulse width is maximized, thereby maximizing the brightness. When the digital video signal has a value of 127, the pulse width is reduced to half of the maximum pulse width, thereby controlling the brightness correspondingly.

The PAM method keeps the pulse width constant regardless of the input digital video signal, and modulates the pulse voltage level, i.e., the pulse amplitude of the driving waveform applied to the data electrode in accordance with the input digital video signal, thereby controlling the brightness.

FIG. 1 illustrates waveforms of input/output signals when a polarity control signal has a high level in a conventional electron emission display. As shown therein, input/output signals of the column driver include a horizontal synchronous signal Hsync, a polarity control signal Pol having a high level, a video data input signal Input Data, which is input to a data driver, and a video data output signal Driver Output, which is output from the data driver.

The video data input signal is input in accordance with the horizontal synchronous signal as a periodic signal for a data line. Here, the video data input signal is converted to have a corresponding pulse width by a PWM method.

For example, when video data input signals having values of "128", "64", "200" and "100" are input in sequence, the video data input signals of 8 bits are converted to respective corresponding pulse widths of "Ta", "Tb", "Tc" and "Td". Here, the pulse widths of "Ta", "Tb", "Tc" and "Td" correspond to brightness levels, respectively. In this example, "Ta"="2 Tb", and "Tc"="2 Td".

Further, the polarity control signal is used for controlling the polarity of the video data output signal output from the data driver. For example, when the polarity control signal has a high level and a signal output from the data driver has a low level, the video data output signal has a high level.

FIG. 2 illustrates waveforms of input/output signals when the polarity control signal has a low level in the conventional electron emission display. As shown therein, input/output signals of the column driver include a horizontal synchronous signal Hsync, a polarity control signal Pol having a low level, a video data input signal Input Data, which is input to a data driver, and a video data output signal Driver Output, which is output from the data driver.

The video data input signal is input in accordance with the horizontal synchronous signal as the periodic signal for the data line. Here, the video data input signal is converted to have a corresponding pulse width by a PWM method.

For example, when video data input signals having values of "128", "64", "200" and "100" are input in sequence, the video data input signals of 8 bits are converted to have pulse widths of "Ta", "Tb", "Tc" and "Td" corresponding to the values of "128", "64", "200" and "100". Here, the pulse widths of "Ta", "Tb", "Tc" and "Td" correspond to brightness levels, respectively. In this example, "Ta"="2 Tb", and "Tc"="2 Td".

Further, the polarity control signal is used for controlling the polarity of the video data output signal output from the data driver. For example, when the polarity control signal has a low level and a signal output from the data driver has a high level, the video data output signal has a low level.

When the video data output signal has the pulse widths of "Ta", "Tb", "Tc" and "Td", a switching frequency is determined in accordance with the resolution of the video data output signal. That is, the switching frequency becomes higher as the resolution increases, thereby increasing power consumption.

In more detail, in the driving apparatus for the electron emission display having a matrix structure, a video signal applied to a column line is converted to have a pulse width corresponding to a predetermined voltage level and the polarity is switched in proportion to a horizontal resolution. Thus, the number of polarity switches of the video signal corresponds to the horizontal resolution.

Here, the power consumption in a column electrode of the electron emission display can be calculated by the following equation.

$$P=c\times\Delta V^2\times f$$

Where, P is power consumption in the column electrode, c is a line capacitance of a display panel, V is a voltage variation of the video signal, and f is a switching frequency.

Thus, the conventional driving method for the electron emission display consumes more power as the resolution increases, i.e., in proportion to the number of times the pulse width is switched.

SUMMARY OF THE INVENTION

The present invention is therefore directed to a driving apparatus and a driving method for an electron emission display which substantially overcome one or more of the problems due to the limitations and disadvantages of the related art.

It is therefore a feature of an embodiment of the present invention to provide a driving apparatus and a driving method for an electron emission display, in which a pulse width of an output signal is switched less often, thereby reducing total power consumption.

At least one of the above and other features and advantages of the present invention may be realized by providing a driving apparatus for an electron emission display, including a controller for comparing external video data input signals, switching a polarity control signal in a predetermined period on the basis of the comparison and controlling a video data output signal in accordance with the polarity control signal, and a data driver for modulating the video data signal output from the controller.

The controller may generate a horizontal synchronous signal and the polarity control signal. The horizontal synchronous signal may include a blanking signal at predetermined intervals. The polarity control signal may be switched in accordance with the blanking signal of the horizontal synchronous signal.

The controller may selectively invert the video data signal every two lines on the basis of the polarity control signal. The data driver may modulate in accordance with a gray level of a video data signal of the first line and an inverted gray level of a video data signal of the second line. The data driver may modulate a pulse width of the inverted video data signal.

The controller may determine whether the compared video data signals have sequential black or white levels. The controller may shift timing for switching the polarity control signal from a low level to a high level by at least a blanking period of a horizontal synchronous signal when the compared video data signals have black levels. The controller may shift timing for switching the polarity control signal from a high level to a low level by at least a blanking period of a horizontal synchronous signal when the compared video data signals have white levels. The controller may shift timing for switching the polarity control signal by at least a blanking period of a horizontal synchronous signal when the compared video data signals have equal levels.

At least one of the above and other features and advantages of the present invention may be realized by providing a method of driving an electron emission display, including receiving a video data signal in response to a horizontal synchronous signal, switching a polarity control signal in accordance with a blanking signal of the horizontal synchronous signal, comparing video data signals received corresponding to two lines, switching the polarity control signal on the basis of the comparison and selectively inverting the video data signal on the basis of the polarity control signal.

The method may include modulating a pulse width of the inverted video data signal. The switching the polarity control signal may include switching the polarity control signal every two lines of the horizontal synchronous signal. The comparing the video data signal may include determining whether the compared video data signals have sequential black or white levels.

When comparing determines the video data signals both have black levels, the method may include shifting timing for switching the polarity control signal from a low level to a high level by at least a blanking period of the horizontal synchronous signal. When comparing determines the video data signals both have white levels, the method may include shifting timing for switching the polarity control signal from a high level to a low level by at least a blanking period of the horizontal synchronous signal. When comparing determines the video data signals have equal levels, the method may include shifting timing for switching the polarity control signal by at least a blanking period of the horizontal synchronous signal.

Selectively inverting the video data signal may include inverting the video data signal every two lines on the basis of the polarity control signal. The method may include modulating the video data signal in accordance with a gray level of a video data signal of the first line and an inverted gray level of a video data signal of the second line.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
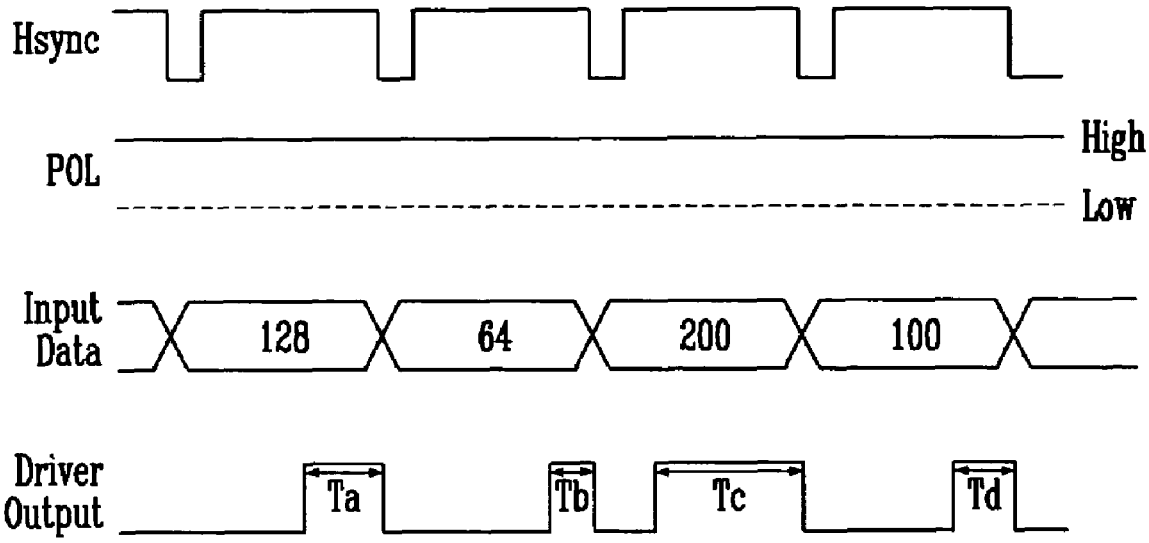
FIG. 1 (PRIOR ART)
FIG. 1 illustrates waveforms of input/output signals when a polarity control signal has a high level in a conventional electron emission display.
Figure 2:
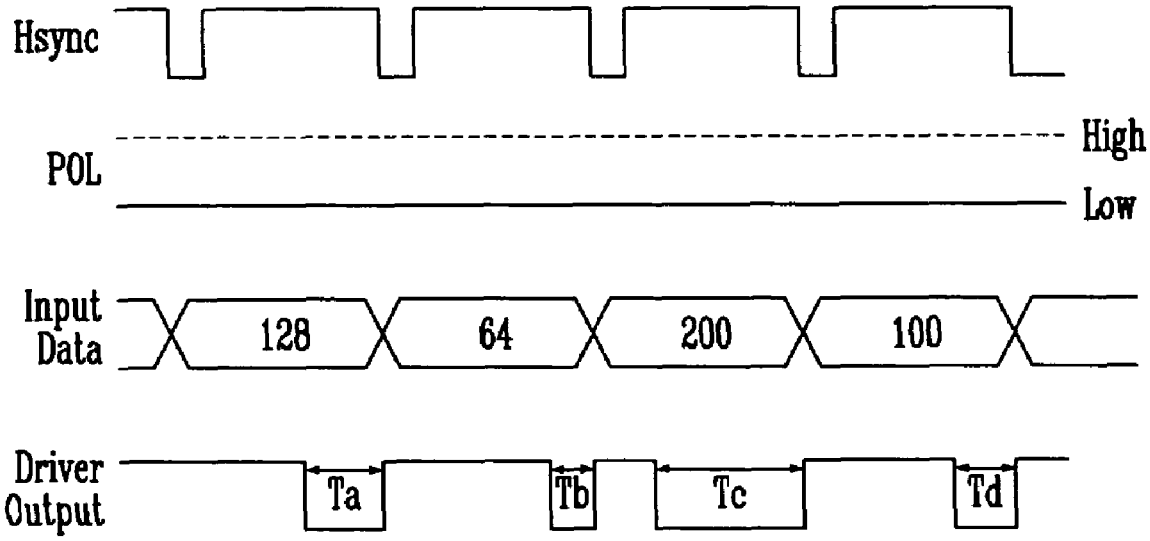
FIG. 2 (PRIOR ART)
FIG. 2 illustrates waveforms of input/output signals when the polarity control signal has a low level in a conventional electron emission display.

Korean Patent Application No. 10-2005-0026171, filed on Mar. 29, 2005, in the Korean Intellectual Property Office, and entitled: "Driving Device for Electron Emission Display Device and the Method Thereof," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. Like reference numerals refer to like elements throughout.

Figure 3:
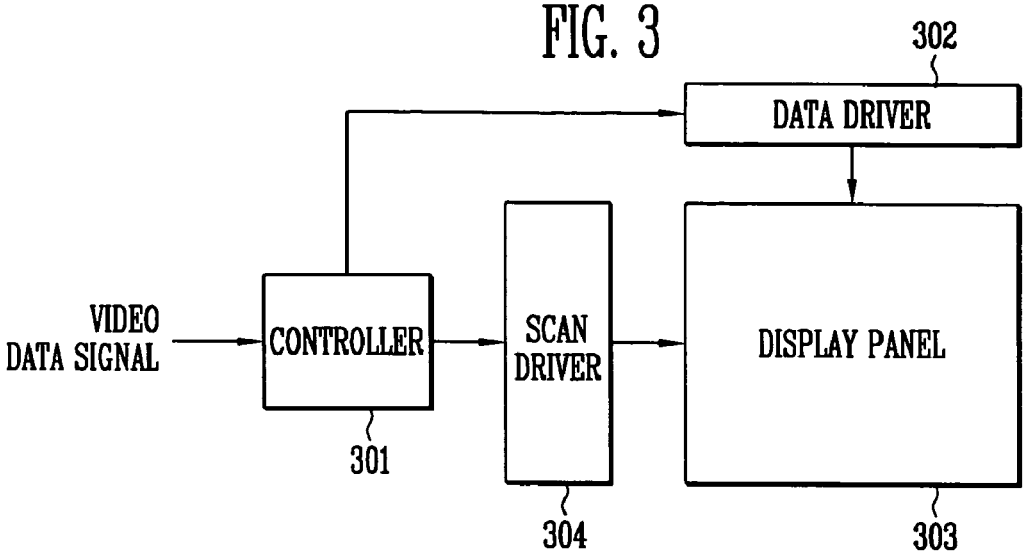
FIG. 3 illustrates a block diagram of a driving apparatus for an electron emission display according to an embodiment of the present invention.

FIG. 3 illustrates a block diagram of a driving apparatus for an electron emission display according to an embodiment of the present invention. As shown in FIG. 3, the driving apparatus according to an embodiment of the present invention may include a controller 301, a data driver 302, a display panel 303 and a scan driver 304.

The controller 301 compares received external video data signals and controls a signal output therefrom on the basis of compared video data information. The data driver 302 modulates the video data signal output from the controller 301. The display panel 303 displays a picture based on the video data signal output from the data driver 302. The scan driver 304 applies a low or high signal to a scan line (not shown) for a predetermined period to select a predetermined row of the display panel 303.

In more detail, the controller 301 controls the output signal by switching a polarity control signal in a predetermined period on the basis of the compared results and outputting a video data signal controlled corresponding to the polarity control signal. When a video data signal of a first line of two sequential lines has a higher gray level than a video data signal of a second line, the video data signal of the first line may be output in a normal state, while the video data signal of the second line may be inverted, as described below with respect to FIG. 4.

In this particular embodiment, the controller 301 generates a horizontal synchronous signal Hsync and a polarity control signal Pol to control the video data signal. The horizontal synchronous signal Hsync may include a blanking signal at predetermined intervals that resets timing to input the video data signal.

The polarity control signal may be used for controlling the waveform polarity of the video data output signal. For example, when the polarity control signal has a high level and the signal output from the data driver 302 has a low level, the video data output signal has a high level. On the other hand, when the polarity control signal has a low level and the signal output from the data driver 302 has a high level, the video data output signal has a low level.

The polarity control signal may be used to switch the video data output signal in accordance with the blanking signal of the horizontal synchronous signal. Further, the video data signal may be selectively inverted on the basis of the polarity control signal every two lines.

Figure 4:
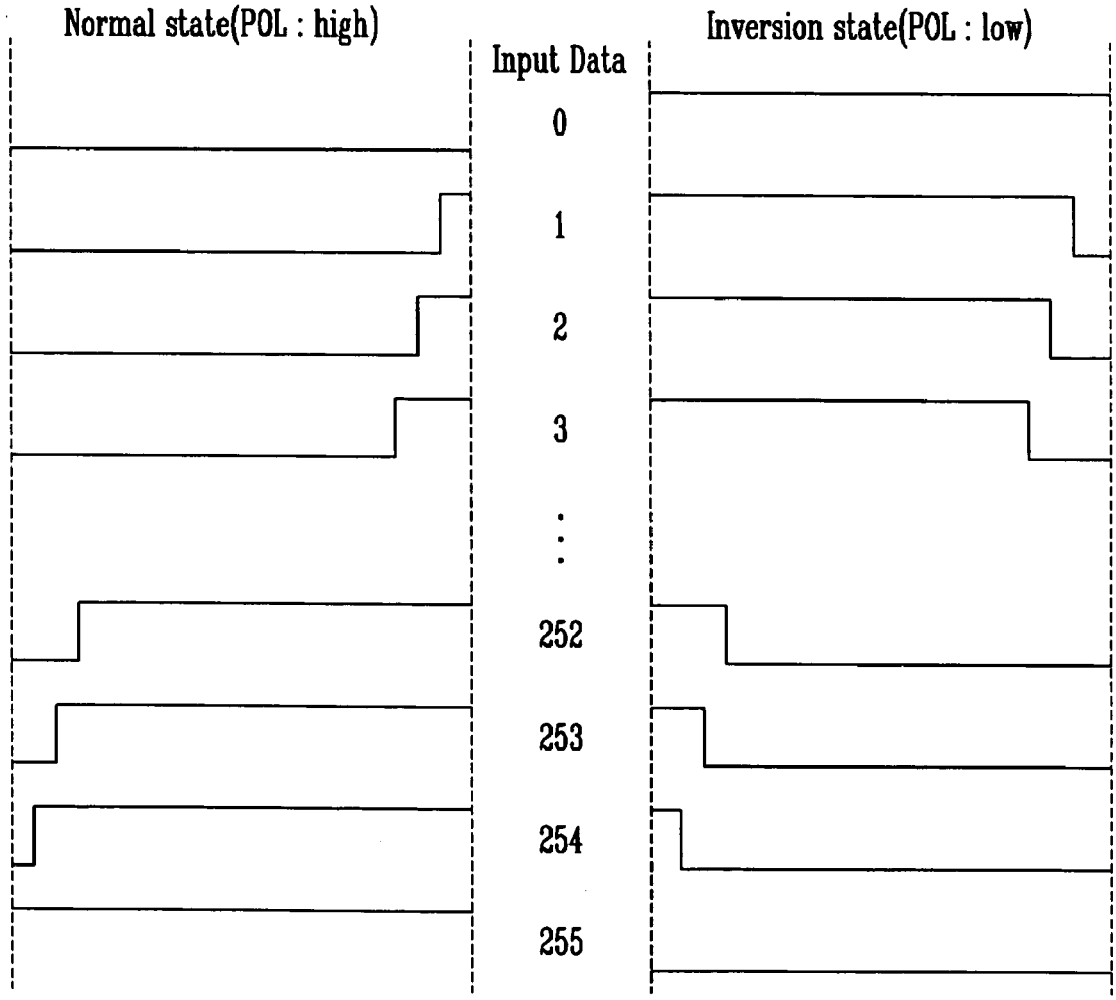
FIG. 4 schematically illustrates gray levels of a video data signal according to a polarity control signal.

FIG. 4 schematically illustrates gray levels of a video data signal according to a polarity control signal. Here, the video data output signal when the polarity control signal has a high level will be regarded as a normal state, which has gray levels as shown in the left side of FIG. 4. The video data output signal when the polarity control signal has a low level will be regarded as an inversion state, which has gray levels as shown in the right side of FIG. 4.

Referring to FIG. 4, the normal state video data input signals having gray levels of "0" through "255" have the same pulse width as the inversion state video data input signals having gray levels of "255" through "0", respectively. Thus, the video data signal selectively output corresponding to the polarity control signal every two lines may be switched with respect to its pulse width frequency every two lines. This will be described in detail below with respect to FIG. 5.

When the controller 301 determines that sequential video data signals have black levels or white levels, this operation may be altered. Here, the sequential video data input signals can be stored in a frame memory (not shown), and then compared.

When compared video data signals have black level signals, the controller 301 may control the timing for switching the polarity control signal from the low level to the high level to be shifted by at least a blanking period of the horizontal synchronous signal. This will be described in detail below with respect to FIG. 7A. When compared video data signals have white level signals, the controller 301 may control the timing for switching the polarity control signal from the high level to the low level to be shifted by at least the blanking period of the horizontal synchronous signal. This will be described in detail below with respect to FIG. 7B.

The data driver 302 may receive the selectively inverted video data signals and modulate the pulse width of the received video data signal. Due to the inverted video data signal, the pulse width may be altered only once every two lines.

The display panel 303 may include a plurality of data lines formed as one of gate and cathode electrodes, a plurality of scan lines formed as the other one of the gate and cathode electrodes, and a plurality of pixels formed in regions where the data lines intersect the scan lines. The pixel may include the gate electrode and the cathode electrode, and may receive a data signal and a scan signal through the data line and the scan line, respectively. Here, a plurality of pixel lines may be selected in sequence by the scan signals input through the scan lines, and the selected pixel lines may receive the data signal through the data line, so that selected pixels emit light, thereby displaying a predetermined image.

A driving method for the electron emission display according to an embodiment of the present invention will be described below.

Figure 5:
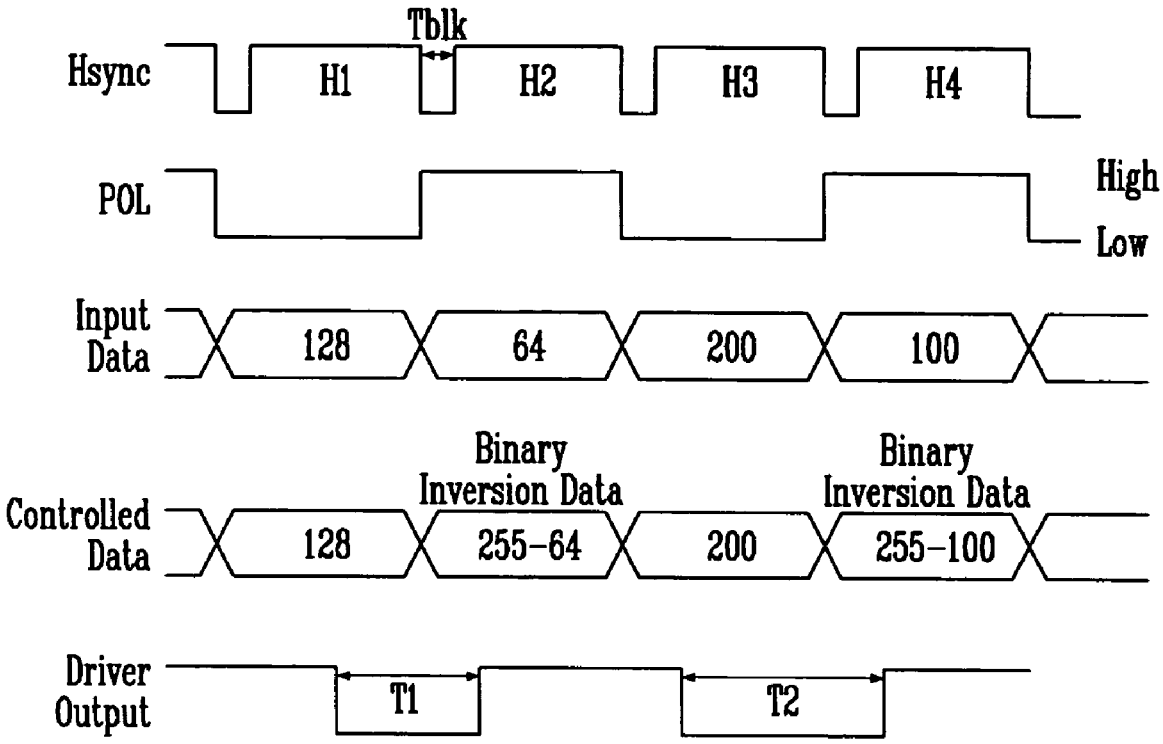
FIG. 5 illustrates waveforms of input/output signals in the driving apparatus for the electron emission display according to an embodiment of the present invention.

FIG. 5 illustrates waveforms of input/output signals in the driving apparatus for the electron emission display according to an embodiment of the present invention. As shown therein, input/output signals of the driving apparatus may include a horizontal synchronous signal Hsync, a polarity control signal Pol, a video data input signal Input Data, a selectively inverted video data signal Controlled Data and a video data output signal Driver Output output from the data driver.

First, the controller 301 receives an external video data input signal. Then, the horizontal synchronous signal and the polarity control signal are generated to control the video data input signal. The horizontal synchronous signal may include a blanking signal Tblk at predetermined intervals, so at to reset the timing of the video data input signal. Further, the polarity control signal may be switched in accordance with the blanking signal of the horizontal synchronous signal to switch the polarity of the video data signal.

In more detail, the blanking signal of the horizontal synchronous signal may be generated in accordance with an on-time corresponding to one line of the video data input signal. At this time, the polarity control signal alternates between a high level and a low level in accordance with the period of the blanking signal and is switched repeatedly every two lines.

Thus, the polarity control signal controls the waveform polarity of the video data output signal. For example, when the polarity control signal has the high level and the signal output from the data driver 302 has the low level, the video data output signal has the high level. On the other hand, when the polarity control signal has the low level and the signal output from the data driver 302 has the high level, the video data output signal has the low level.

Then, it is determined that the video data input signals corresponding to two lines are compared, and then the polarity control signal is controlled on the basis of the compared result. Then, the video data signals are selectively inverted every two times on the basis of the polarity control signal.

In more detail, the video data signal is inverted on the basis of the polarity control signal. That is, the video data signal is selectively processed by a binary inversion based on the polarity control signal, so that the binary inverted video data signal is output. In this example, the video data signal is switched every two lines.

For example, when the video data input signals have levels of "128", "64", "200" and "100", the first video data signal having a level of "128" is output without inversion on the basis of the polarity control signal and the second video data signal having a level of "64" is switched by the binary inversion to have a level of "255-64" on the basis of the polarity control signal.

Further, the third video data signal having a level or "200" is output as a non-inversion signal, and the fourth video data signal having a level of "100" is output as a binary inversion signal having a level of "255-100". Thus, the video data signal is selectively inverted and output on the basis of the polarity control signal. Further, the data driver 302 modulates the pulse width of the inverted video data signal.

For example, when the video data input signals having levels of "128", "64", "200" and "100" are input in sequence, one pulse width frequency is output by mixing the video data signal having a gray level of "128" with the binary inverted video data signal having a gray level of "255-64" and another pulse width frequency is output by mixing the video data signal having a gray level of "200" with the binary inverted video data signal having a gray level of "255-100".

Thus, the video data output signal has a pulse width of "T1" corresponding to the gray level sum of "128" and "255-64", and a pulse width of "T2" corresponding to the gray level sum of "200" and "255-100". Likewise, the binary inverted video data signals are repeatedly switched by one pulse width frequency every two lines.

Furthermore, when the controller 301 determines the sequential video data signals being compared are all black (0) or white (255), an unnecessary switching operation may be performed by the polarity control signal, thereby increasing power consumption due to the switching operation.

Figure 6A:
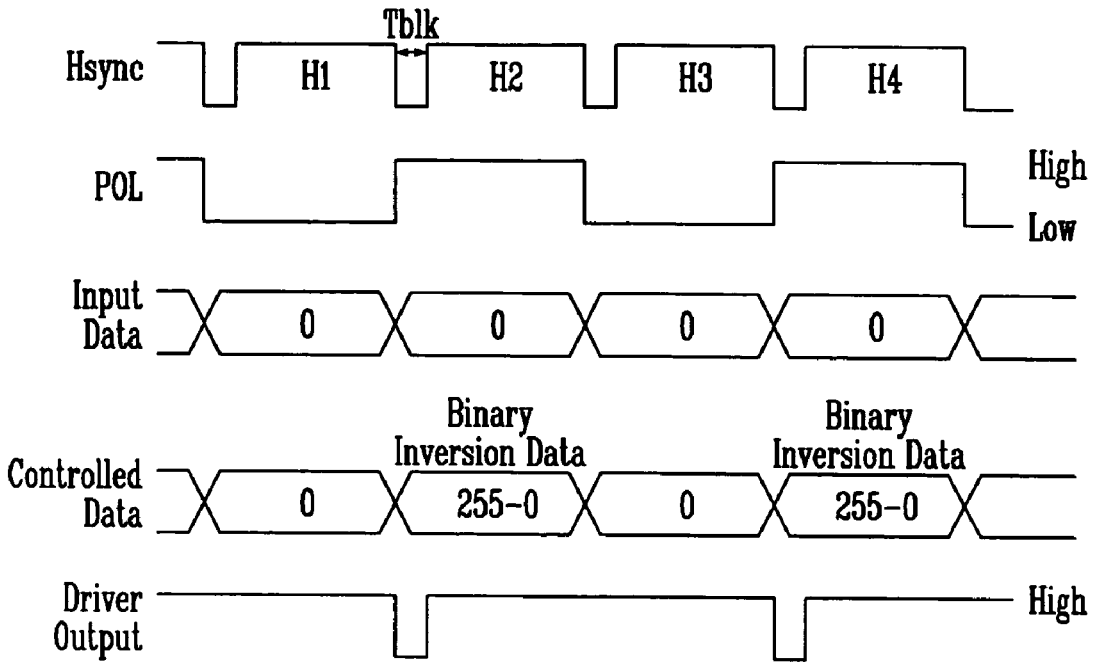
FIG. 6A illustrates waveforms of the video data output signal having a black level when the polarity control signal is not controlled.

FIG. 6A illustrates waveforms used in driving the electron emission display according to an embodiment of the present invention. In accordance with the operation described above, even when the video data output signal has a black level, the polarity control signal is still switched. As shown in FIG. 6A, input/output signals of the driving apparatus include a horizontal synchronous signal Hsync, a polarity control signal Pol, a video data input signal Input Data having the black level, a selectively inverted video data signal Controlled Data and a video data output signal Driver Output output from the data driver. When the signal output from the data driver has the high level, the video data signal, which has the black level, output when the polarity control signal is switched from the low level to the high level, is switched by the blanking signal of the horizontal synchronous signal.

Figure 6B:
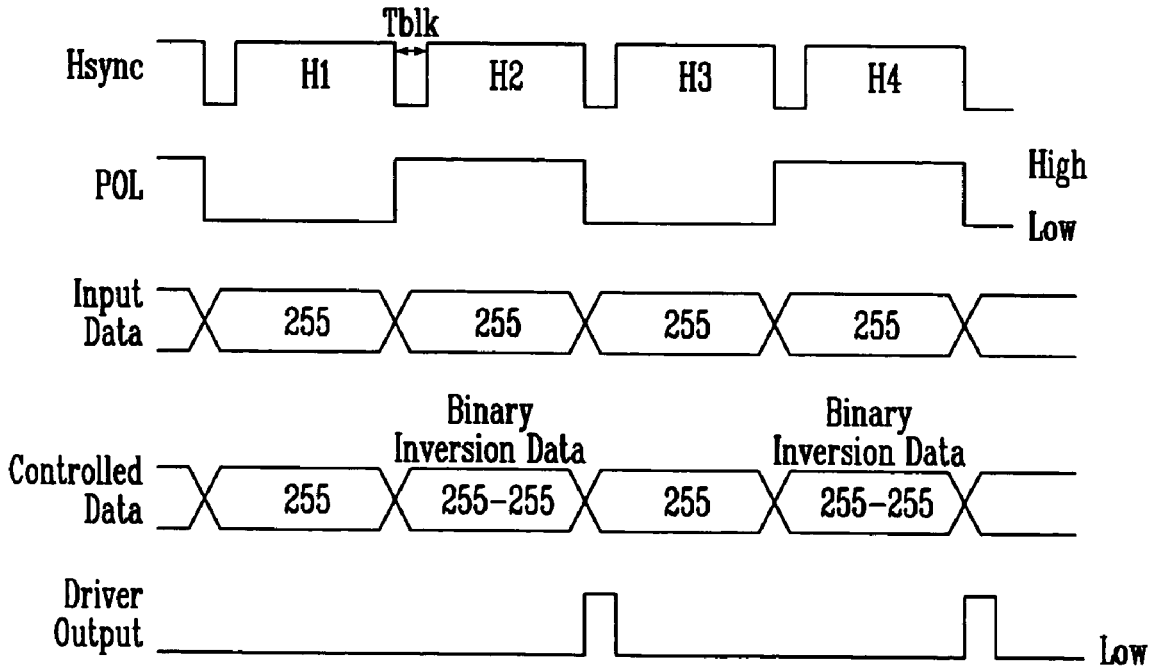
FIG. 6B illustrates waveforms of the video data output signal having a white level when the polarity control signal is not controlled.

FIG. 6B illustrates waveforms used in driving the electron emission display according to an embodiment of the present invention. In accordance with the operation described above, even when the video data output signal has a white level, the polarity control signal is still switched. As shown in FIG. 6B, input/output signals of the driving apparatus include a horizontal synchronous signal Hsync, a polarity control signal Pol, a video data input signal Input Data having the white level, a selectively inverted video data signal Controlled Data and a video data output signal Driver Output output from the data driver. When the signal output from the data driver has the low level, the video data signal, which has the white level, output when the polarity control signal is switched from the high level to the low level, is switched by the blanking signal of the horizontal synchronous signal.

In order to avoid this unnecessary switch, when sequential video data input signals have black levels or white levels, the pulse width modulated signal output from the data driver may not be switched on the basis of the polarity control signal.

Figure 7A:
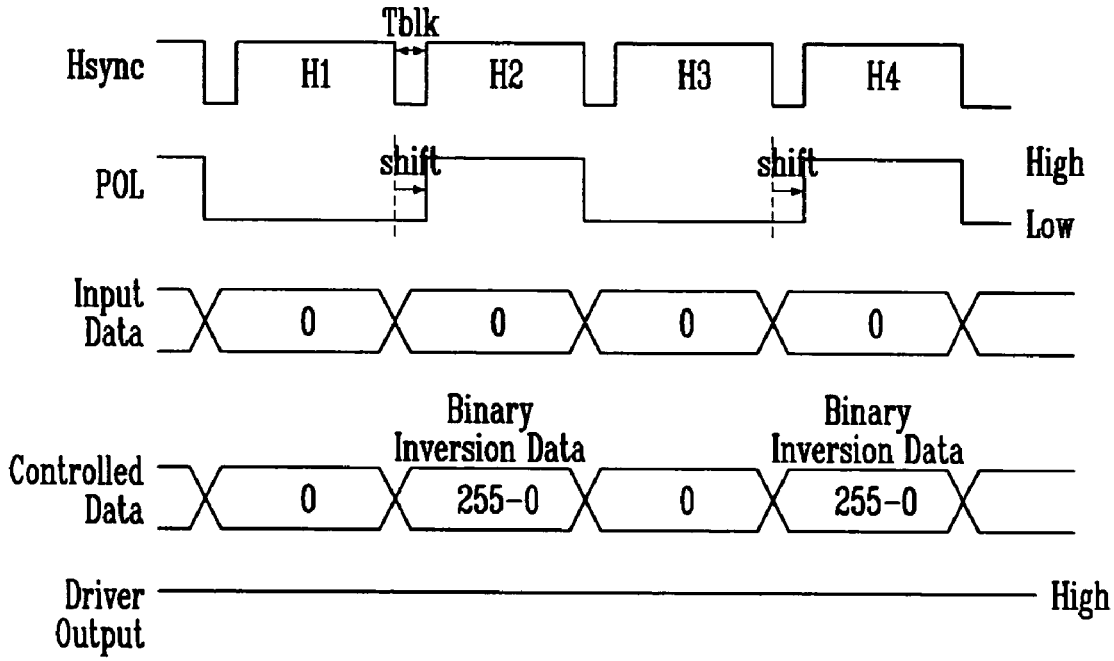
FIG. 7A illustrates waveforms of the video data output signal having a black level when the polarity control signal is controlled.

FIG. 7A illustrates waveforms used in driving the electron emission display according to another embodiment of the present invention. In accordance with the present embodiment, when the video data output signal has a black level, the polarity control signal is not switched. As shown in FIG. 7A, input/output signals of the driving apparatus include a horizontal synchronous signal Hsync, a polarity control signal Pol, a video data input signal Input Data having the black level, a selectively inverted video data signal Controlled Data and a video data output signal Driver Output output from the data driver.

When the video data input signals have sequential black levels, the timing for switching the polarity control signal from the low level to the high level may be shifted, e.g., by at least the blanking period of the horizontal synchronous signal. In other words, the polarity control signal is inverted in accordance with the blanking signal of the horizontal synchronous signal, i.e., the inverting timing is delayed by the blanking period without the period variance of the polarity control signal when the polarity control signal is switched from the low level to the high level.

Figure 7B:
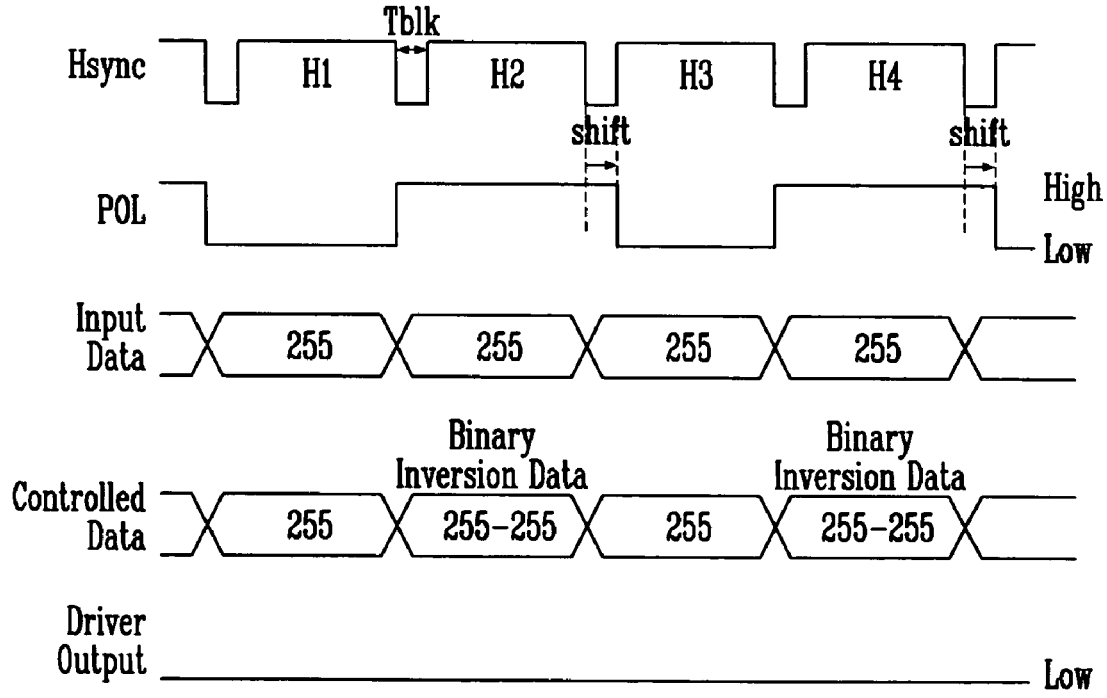
FIG. 7B illustrates waveforms of the video data output signal having a white level when the polarity control signal is controlled.

FIG. 7B illustrates waveforms used in driving the electron emission display according to another embodiment of the present invention. In this embodiment, when the video data output signal has a white level, the polarity control signal is not switched. As shown in FIG. 7B, input/output signals of the driving apparatus include a horizontal synchronous signal Hsync, a polarity control signal Pol, a video data input signal Input Data having the white level, a selectively inverted video data signal Controlled Data and a video data output signal Driver Output output from the data driver.

When the video data input signals have sequential white levels, the timing for switching the polarity control signal from the low level to the high level is shifted by the blanking period of the horizontal synchronous signal. In other words, the polarity control signal is inverted in accordance with the blanking signal of the horizontal synchronous signal, i.e., the inverting timing may be delayed by at least the blanking period without the period variance of the polarity control signal when the polarity control signal is switched from the high level to the low level.

Thus, when the video data input signals have sequential black or white levels, the switching operation is not performed, thereby further reducing noise and power consumption.

As described above, the present invention provides a driving apparatus and a driving method for an electron emission display, in which a pulse width of an output signal is altered less frequently to reduce total power consumption. When there are sequential black or white levels, the pulse width may not be altered, thereby further reducing total power consumption.

Exemplary embodiments of the present invention have been disclosed herein, and although specific terms are employed, they are used and are to be interpreted in a generic and descriptive sense only and not for purpose of limitation. For example, while the reduced power consumption realized by not switching the polarity control signal has been discussed relative to sequential black or white levels, such lack of switching may be employed whenever sequential signals are equal. Accordingly, it will be understood by those of ordinary skill in the art that various changes in form and details may be made without departing from the spirit and scope of the present invention as set forth in the following claims.

What is claimed is:

1. A driving apparatus for an electron emission display, comprising:

a controller for comparing a first external video data input signal to a second external video data input signal, the first and second video data input signals corresponding to sequential first and second lines, the controller switching a polarity control signal in a predetermined manner on the basis of the comparison and controlling inversion of video data in accordance with the polarity control signal; and a data driver for modulating a driver output in accordance with a video data output signal, the video data output signal being output from the controller, wherein:

a polarity of the polarity control signal is changed from a first polarity to a second polarity, and then the polarity of the polarity control signal is changed from the second polarity to the first polarity, a duration of the polarity control signal at the first polarity is increased when the first and second video data input signals have a same first value relative to the duration of the polarity control signal at the first polarity when the first and second video data input signals do not have the same first value, a duration of the polarity control signal at the second polarity is increased when the first and second video data input signals have a same second value relative to the duration of the polarity control signal at the second polarity when the first and second video data input signals do not have the same second value, and the first value is different from the second value.

2. The driving apparatus as claimed in claim 1, wherein the controller generates a horizontal synchronous signal and the polarity control signal.

3. The driving apparatus as claimed in claim 2, wherein the horizontal synchronous signal comprises a blanking period at predetermined intervals.

4. The driving apparatus as claimed in claim 3, wherein the polarity control signal is switched in accordance with the blanking period of the horizontal synchronous signal.

5. The driving apparatus as claimed in claim 3, wherein:

the controller selectively inverts the video data output signal every two sequential lines of the horizontal synchronous signal on the basis of the polarity control signal, and for a first period of the polarity control signal that is defined as being a time from a first change in polarity of the polarity control signal from the first polarity to the second polarity to an immediately subsequent second change in polarity of the polarity control signal from the first polarity to the second polarity:

the first period of the polarity control signal is a first value corresponding to a period of the two sequential lines of the horizontal synchronous signal when the first and second video data signals do have the same first value and do not have the same second value, the first period of the polarity control signal is maintained at the first value when the first and second video data signals have the same first value, and the first period of the polarity control signal is selectively varied when the first and second video data signals have the same second value.

6. The driving apparatus as claimed in claim 5, wherein the data driver modulates in accordance with a gray level of the first video data input signal of the first line and an inverted gray level of the second video data input signal of the second line.

7. The driving apparatus as claimed in claim 5, wherein the data driver modulates a pulse width of the inverted video data output signal.

8. The driving apparatus as claimed in claim 3, wherein the controller determines whether the compared first and second video data input signals have sequential black or white levels.

9. The driving apparatus as claimed in claim 8, wherein, when the compared first and second video data input signals both have black levels, the controller shifts timing of a change in polarity of the polarity control signal from a low level to a high level by at least a blanking period of the horizontal synchronous signal, such that the timing of the change in polarity of the polarity control signal from the low level to the high level is not aligned with a beginning of a blanking period, while maintaining timing of an immediately subsequent change in polarity of the polarity control signal from the high level to the low level to be a constant, such that the timing of the immediately subsequent change in polarity of the polarity control signal from the high level to the low level is aligned with a beginning of a blanking period.

10. The driving apparatus as claimed in claim 9, wherein, when the compared first and second video data input signals both have white levels, the controller shifts timing of the change in polarity of the polarity control signal from the high level to the low level by at least a blanking period of the horizontal synchronous signal, such that the timing of the change in polarity of the polarity control signal from the high level to the low level is not aligned with a beginning of a blanking period, while maintaining timing of an immediately subsequent change in polarity of the polarity control signal from the low level to the high level to be a constant, such that the timing of the immediately subsequent change in polarity of the polarity control signal from the low level to the high level is aligned with a beginning of a blanking period.

11. The driving apparatus as claimed in claim 8, wherein, when the compared first and second video data input signals both have white levels, the controller shifts timing of a change in polarity of the polarity control signal from a high level to a low level by at least a blanking period of the a horizontal synchronous signal, such that the timing of the change in polarity of the polarity control signal from the high level to the low level is not aligned with a beginning of a blanking period, while maintaining timing of an immediately subsequent change in polarity of the polarity control signal from the low level to the high level to be a constant, such that the timing of the immediately subsequent change in polarity of the polarity control signal from the low level to the high level is aligned with a beginning of a blanking period.

12. The driving apparatus as claimed in claim 1, wherein the controller shifts timing for switching the polarity control signal by at least a blanking period of a horizontal synchronous signal when the compared first and second video data input signals both have equal levels.

13. A method of driving an electron emission display, comprising:

providing a horizontal synchronous signal that includes a blanking period, the blanking period starting with a first change in polarity and ending with a second change in polarity;

receiving video data as a periodic signal, the periodic signal having a period corresponding to a period of the horizontal synchronous signal;

comparing a first video data signal to a second video data signal, the first and second video data signals being received corresponding to two sequential lines;

selectively inverting the received video data to output an inverted video data signal in accordance with a polarity control signal; and changing a polarity of the polarity control signal from a first polarity to a second polarity, and then changing the polarity of the polarity control signal from the second polarity to the first polarity, wherein:

a duration of the polarity control signal at the first polarity is increased when the first and second video data signals have a same first value relative to the duration of the polarity control signal at the first polarity when the first and second video data signals do not have the same first value, and a duration of the polarity control signal at the second polarity is increased when the first and second video data signals have a same second value relative to the duration of the polarity control signal at the second polarity when the first and second video data signals do not have the same second value, and the first value is different from the second value.

14. The method as claimed in claim 13, further comprising modulating a pulse width of a driver output in accordance with the inverted video data signal.

15. The method as claimed in claim 14, further comprising modulating the pulse width of the driver output in accordance with a gray level and an inverted gray level of the two sequential lines.

16. The method as claimed in claim 13, wherein, for a first period of the polarity control signal that is defined as being a time from a first change in polarity of the polarity control signal from the first polarity to the second polarity to an immediately subsequent second change in polarity of the polarity control signal from the first polarity to the second polarity:

the first period of the polarity control signal is a first value corresponding to a period two sequential lines of the horizontal synchronous signal when the first and second video data signals do have the same first value and do not have the same second value, the first period of the polarity control signal is maintained at the first value when the first and second video data signals have the same first value, and the first period of the polarity control signal is selectively varied when the first and second video data signals have the same second value.

17. The method as claimed in claim 13, wherein comparing the received video data signal comprises determining whether the two compared video data signals corresponding to the two sequential lines have sequential black or white levels.

18. The method as claimed in claim 17, further comprising, when comparing determines that the first and second video data signals both have black levels, shifting timing of a change in polarity of the polarity control signal from a low level to a high level by at least a blanking period of the horizontal synchronous signal, such that the timing of the change in polarity of the polarity control signal from the low level to the high level is not aligned with a beginning of a blanking period, while maintaining timing of an immediately subsequent change in polarity of the polarity control signal from the high level to the low level to be a constant, such that the timing of the immediately subsequent change in polarity of the polarity control signal from the high level to the low level is aligned with a beginning of a blanking period.

19. The method as claimed in claim 18, further comprising, when comparing determines that the first and second video data signals both have white levels, shifting timing of a change in polarity of the polarity control signal from the high level to the low level by at least a blanking period of the horizontal synchronous signal, such that the timing of the change in polarity of the polarity control signal from the high level to the low level is not aligned with a beginning of a blanking period, while maintaining timing of an immediately subsequent change in polarity of the polarity control signal from the low level to the high level to be a constant, such that the timing of the immediately subsequent change in polarity of the polarity control signal from the low level to the high level is aligned with a beginning of a blanking period.

20. The method as claimed in claim 17, further comprising, when comparing determines the first and second video data signals both have white levels, shifting timing of a change in polarity of the polarity control signal from a high level to a low level by at least a blanking period of the horizontal synchronous signal, such that the timing of the change in polarity of the polarity control signal from the high level to the low level is not aligned with a beginning of a blanking period, while maintaining timing of an immediately subsequent change in polarity of the polarity control signal from the low level to the high level to be a constant, such that the timing of the immediately subsequent change in polarity of the polarity control signal from the low level to the high level is aligned with a beginning of a blanking period.

21. The method as claimed in claim 13, wherein selectively inverting the received video data signal comprises inverting video data every two lines on the basis of the polarity control signal.

22. The method as claimed in claim 13, further comprising, when comparing determines the two video data signals corresponding to the two sequential lines both have equal levels, shifting timing for switching the polarity control signal by at least a blanking period of the horizontal synchronous signal.

23. A method of driving an electron emission display, comprising:

providing a horizontal synchronous signal, the horizontal synchronous signal including a blanking period that starts with a first change in polarity and ends with a second change in polarity;

selectively changing a timing of a polarity control signal, the polarity control signal having high and low states, by changing a time at which the polarity control signal switches between the high and low states based on whether sequentially-received video data are the same or not the same; and inverting received video data in accordance with the polarity control signal, wherein:

the time at which the polarity control signal switches between the high and low states is altered relative to the start and end of the blanking period based on whether sequential video data are the same or not the same.

* * * * *